United States Patent [19]

Howard et al.

[11] 3,981,189

[45] Sept. 21, 1976

[54] METHODS AND STEAM SAMPLERS WITH INERTIAL LATCH

[75] Inventors: Curtis E. Howard, Humble; Douglas G. Calvin, Houston, both of Tex.

[73] Assignee: Texaco Inc., New York, N.Y.

[22] Filed: Apr. 14, 1975

[21] Appl. No.: 567,787

Related U.S. Application Data

[63] Continuation-in-part of Ser. No. 528,073, Nov. 29, 1974, Pat. No. 3,934,469.

[52] U.S. Cl. ..... 73/155; 166/264

[51] Int. Cl.[2] ..... E21B 47/00

[58] Field of Search ..... 73/155, 425.4; 166/57, 166/264, 162, 168

[56] References Cited

UNITED STATES PATENTS

| | | | |
|---|---|---|---|
| 3,103,813 | 9/1963 | Bourne et al. | 73/155 |
| 3,249,054 | 5/1966 | Hill | 73/155 |

*Primary Examiner*—S. Clement Swisher
*Attorney, Agent, or Firm*—T. H. Whaley; C. G. Ries; Theron H. Nichols

[57] ABSTRACT

Two methods and two steam samplers are disclosed for sampling steam, at any location or depth in a steam injection well for determining the quality of the saturated steam at that location. The samplers each comprise an elongated cylindrical vessel with a tube having openings mounted longitudinally internally of the vessel for forming an annulus between the vessel and the tube for trapping the steam liquid phase and vapor phase, while ejecting the excess liquid phase and steam vapor phase out the bottom of the tube. The tube has a second internally sliding rod for closing the openings and a spring and J-latch with a weight for releasably locking the tubes in closed position at any depth in the well by a sudden downward inertial force for shearing a locking pin and a subsequent upward spring movement to the closed and locked upper position for sealing the steam condensate and vapor in the annulus for recovery at the surface. A method for sampling and a method for forming a sampler, as well as two latch combinations are disclosed.

10 Claims, 10 Drawing Figures

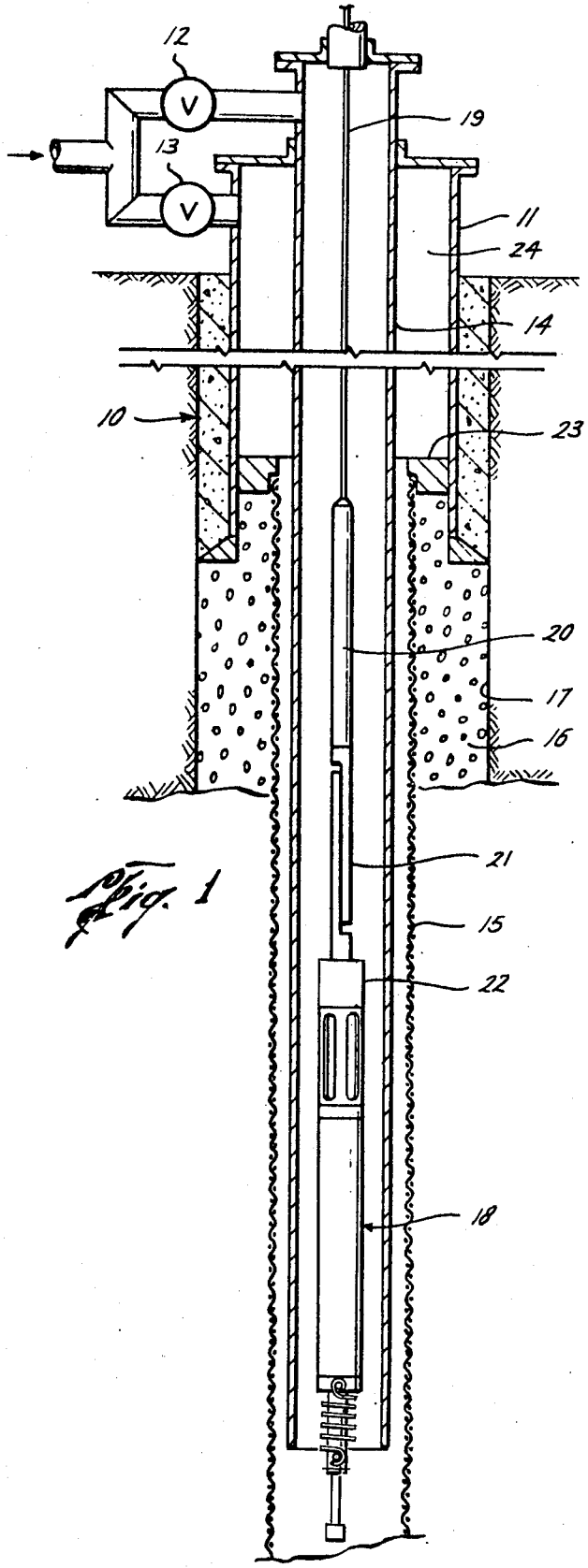
Fig. 1
Fig. 2
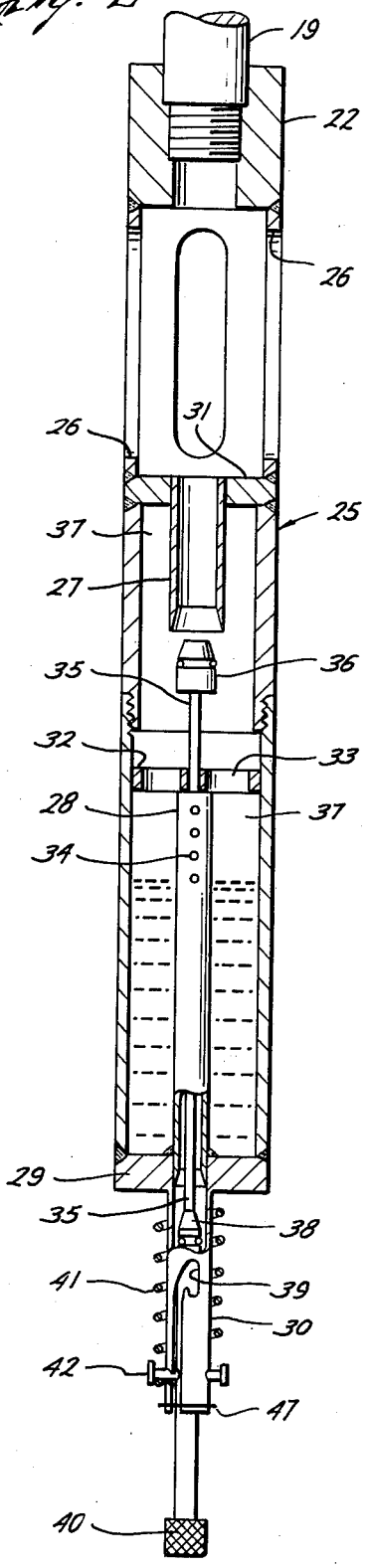

37
28
35
18
38
29
41
42
4
4
39
30
43
47
40

41
39
35
30
39
42

35
28
18
29
44
39
41
30
42
43
47
40

METHODS AND STEAM SAMPLERS WITH INERTIAL LATCH

CROSS REFERENCE TO RELATED APPLICATION

This application is a Continuation-In-Part of our patent application Ser. No. 528,073, filed Nov. 29, 1974 now U.S. Pat. No. 3,934,469.

BACKGROUND OF THE INVENTION

As an aid to improving steam flood efficiency in secondary recovery in old oil or depleted wells for example, it is greatly beneficial to know the steam quality at any desired location in the well or sandface of a steam injection well. It would be desirable to collect and trap a representative sample of the steam liquid droplets and/or the vapor phase flowing to the sandface and retrieve this sample for analyzing. The sample could then be checked for either total dissolved solids or chloride content and compared to the steam generator feedwater total dissolved solids or chlorides. Hence, the quality may be determined from a ratio of the total dissolved solids or chlorides of the steam entering the wellhead to the total dissolved solids or chlorides in the condensate from the sampler at any desired location in the well, as at the bottom of the well.

OBJECTS OF THE INVENTION

Accordingly, a primary object of this invention is to provide at least one method for collecting a sample of steam at any desired location in a well to determine the quality of the steam that has arrived at that location for injection purposes, for example, compared to the quality of the steam prior to entry into the well.

Another primary object of this invention is to provide at least one method for forming or assembling a sampler for sampling steam at any desired depth in a well.

And still another primary object of this invention is to provide at least two samplers for sampling steam at any desired location in a well.

A further object of this invention is to provide a method for sampling steam at the bottom of a well, a method for forming or assembling a sampler for sampling steam at any desired location in a well, and at least two steam samplers, each of which is easy to operate, is of simple configuration, is economical to build and assemble, and is of greater efficiency for sampling steam at any desired depth in a well just prior to penetrating the surface of a petroliferous strata of an oil well, for example.

Other objects and various advantages of the disclosed methods and steam samplers will be apparent from the following detailed description, together with the accompanying drawings, submitted for purposes of illustration only and not intended to define the scope of the invention, reference being had for that purpose to the subjoined claims.

DESCRIPTION OF THE INVENTION

The invention disclosed herein, the scope of which being defined in the appended claims, is not limited in its application to the details of construction and arrangement of parts shown and described for carrying out the disclosed methods, since the invention is capable of other embodiments for carrying out other methods and of being practiced or carried out or assembled in various other ways. Also, it is to be understood that the phraseology or terminology employed herein is for the purpose of description and not of limitation. Further, many modifications and variations of the invention as hereinbefore set forth will occur to those skilled in the art. Therefore, all such modifications and variations which are within the spirit and scope of the invention herein are included and only such limitations should be imposed as are indicated in the appended claims.

DESCRIPTION OF THE INVENTION

This invention comprises a method for sampling steam at any location from the bottom to the top of a well for determining the quality of the steam just prior to injection into the formation, a method for forming or assembling a steam sampler, and two mechanisms for practicing the methods or other methods.

METHOD FOR SAMPLING STEAM

A typical method of the invention for collecting a sample of steam at any desired location in a well to determine the quality of the steam that has arrived at that desired location for injection into the petroliferous strata formation relative to the steam quality input at the surface comprises the method steps of, 1. passing the steam that has arrived at the desired location in the well into the upper end of a cylindrical collecting vessel,
2. passing the steam from the upper end of the cylindrical vessel down into the upper end of a tube means positioned longitudinally internally of the cylindrical vessel,
3. passing a portion of the steam comprising a vapor phase and a liquid phase straight through the tube means to exit from the bottom of the cylindrical vessel,
4. passing the remainder of the steam vapor phase and liquid phase into an annulus formed between the tube and the cylinder,
5. passing the steam vapor phase portion that has entered the annulus back out of the annulus into the tube means,
6. passing the steam vapor phase from the tube means out of the lower end of the cylindrical vessel,
7. collecting the steam liquid phase in the annulus until the liquid level reaches the lowest opening in the tube means for collecting a predetermined amount of liquid as about 200cc (cubic centimeters) in the disclosed embodiments of the annulus,
8. flowing out of the annulus at least an amount of liquid phase equal to the new steam liquid phase collected thereafter to purge the annulus of the first formed steam liquid phase, and
9. sealing the sample of steam liquid phase in the annulus for recovery at the surface.

More briefly stated, the method for collecting a sample of well bottom steam comprises, 1. passing the steam that has arrived at the desired location in the well through a tube means internally of a cylindrical collecting vessel,
2. passing a portion of the steam vapor phase and liquid phase from the tube means through an upper opening in the tube means out into an annulus formed between the tube means and the cylindrical collecting vessel,
3. passing the steam vapor phase back into the tube means through side openings therein and out an opening in the bottom of the tube means,
4. collecting the steam liquid phase and vapor phase in the annulus, and 5. sealing the annulus with a sample of steam liquid phase and steam vapor phase therein for recovery at the surface.

METHOD FOR ASSEMBLING A STEAM SAMPLER

A method for forming or assembling a sampler for collecting a sample of steam comprising a vapor and a liquid at any desired location in a well to determine the quality of the steam that has arrived at that location for injection into the petroliferous strata formation relative to the steam quality input at the surface comprises the method steps of, 1. forming an elongated cylinder having closed upper and lower ends with a diameter substantially less that that of the well in which the sampler is lowered, 2. attaching a coupling means on the cylinder upper end for connecting to a cable for supporting and lowering the cylinder to the desired position in the well, 3. forming slots in the cylinder upper end for receiving the steam, 4. fixedly mounting with an annular disk the top of an upper tube of two upper and lower co-axial, spaced apart tubes concentrically in the upper portion of the cylinder below the slots for receiving the steam from the slots and for sealing the top of the upper portion of an annulus formed between the tubes and the cylinder, 5. fixedly mounting with a second annular disk the lower end of the lower co-axial tube concentrically in the cylinder lower end for sealing the bottom of the lower portion of the annulus formed between the tubes and the cylinder, 6. spacing the two co-axial tubes axially from each other a substantial distance apart so that a portion of the steam including the steam liquid phase and the steam vapor phase passes out into the annulus, 7. perforating the upper end of the lower tube so that the steam vapor phase passes back into the lower tube through the perforations therein for exhausting from the cylinder bottom as the steam liquid phase collects in the annulus up to the perforations, 8. slideably mounting a sealing rod internally of the lower co-axial tube with a lower portion of the sealing rod protruding below the cylinder so that after a sudden downward acceleration is applied to the sealing rod, the sealing rod is actuated upwardly from a lowermost position to an uppermost position to close the upper tube and bottom of the lower co-axial tube for sealing the annulus with steam liquid phase and steam vapor phase therein for recovery at the surface, and 9. said slideably mounted sealing rod has latch means for releasing the sealing rod from a locked lowermost position to a locked uppermost position for sealing the liquid and vapor in the annulus for recovery at the surface.

A variation of the method above in the forming of a sampler comprises incorporation of the following method step, !. forming a corresponding J-latch on the cylinder lower end for connecting with the latch means on the sealing rod for locking the sealing rod in its uppermost position for sealing the liquid and vapor in the annulus.

Another variation of the method of forming a sampler above comprises the incorporation of the following method step, 1. mounting a corresponding pin-latch on the sealing rod for connecting with the latch means on the lower co-axial tube for locking the sealing rod in its uppermost position for sealing the liquid and vapor in the annulus.

BRIEF DESCRIPTION OF THE DRAWINGS

The drawings diagrammatically illustrate by way of example, not by way of limitation, two forms or mechanisms for carrying out the methods of the invention wherein like reference numerals have been employed to indicate similar parts in the several views in which:

FIG. 1 is a schematic vertical view of one embodiment of the sampler while hanging from a wireline in a well in open position for the deposit of steam vapor and liquid therein;

FIG. 2 is a schematic longitudinal sectional view of the embodiment of the sampler of FIG. 1 in open sample taking position;

A FIRST STEAM SAMPLER

Figure 3A:
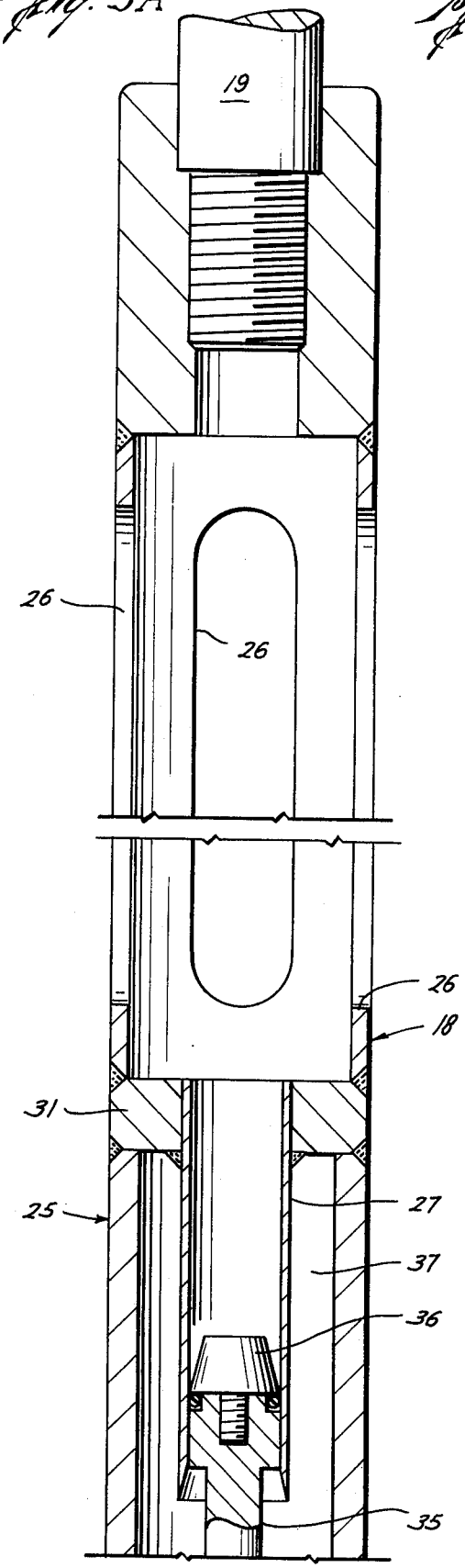
FIG. 3A is an enlarged sectional view of the upper portion of the sampler of FIG. 2, illustrated in closed position.

FIGS. 1–5 disclose the first embodiment of sampler 18. FIG. 1 illustrates schematically an injection well 10 for example having casing 11 in which steam is generated on the surface and injected under high pressure through valves 12 and 13 into the well, as down inside of tube 14, for example, to emerge below for penetrating a screen 15, gravel pack 16, and for passing into the petroliferous formation 17 for displacing the oil therein toward production wells nearby.

Further in FIG. 1 is the disclosed steam sampler 18 supported at the desired position or depth in the well by a typical wireline or cable 19 having a weight 20, a set of mechanical jars 21, and a suitable sucker rod coupling 22. The bottom of the screen 15 represents the location of the lower portion of the petroliferous formation strata, whether it be at the actual bottom of the well or anywhere along the well, as illustrated. A packer 23 seals the top of the gravel pack 16 between the casing 11 and screen 15. In this disclosure, the injection well 10 may have various fluids injected therein and the fluid vapor phase and fluid liquid phase collected, such as, but not limited to, the fluid steam with its vapor phase and its liquid phase. In the case of 80% quality of steam, for example, 80%, by mass, of the steam is the vapor phase and 20%, by mass, of the steam is the liquid phase.

While steam is supplied from a suitable source to steam valves 12 and 13 internally of either the tube 14, or an annulus 24 formed between the tube and the casing 11 as controlled with valves 12 and 13, the steam must be supplied through tube 14 when the sampler is lowered in the tube for taking a sample.

FIG. 2, an enlarged longitudinal sectional view of one embodiment of the sampler 18, per se, and FIGS. 3A–3C, 4, and 5 are detailed views of the sampler. For clarity of disclosure, the weight 20 and mechanical jars 21 of FIG. 1 are deleted in all FIGS., other than FIG. 1. An elongated cylindrical sampling vessel 25, FIGS. 2 and 3A, is disclosed with slots 26 in the walls of the upper end and with two-co-axial, upper and lower tubes 27, 28, FIG. 2, mounted concentrically and co-axially with the cylindrical vessel and extending from a position just under the slots to the bottom of the vessel to protrude therefrom.

The cylindrical vessel 25, FIG. 2, consisting of two portions screwed together, is closed at its upper end with sucker rod coupling 22, and the lower end of the cylindrical vessel is closed with a lower ring 29 between the bottom of the lower tube 28 and the vessel. The lower ring member 29 has attached thereto a short tube 30 for extending the exit of the lower tube 28 and for forming a latch therein, described hereinafter. Upper tube 27, FIGS. 2 and 3A, is mounted in the cylindrical vessel 25 just below the slots 26 in an upper ring member 31. In the cylindrical vessel 25 illustrated in FIG. 2, the cylindrical upper portion and the cylindrical lower portion are connected together in a suitable manner, such as but not limited to, with screw threads for ease of assembly and disassembly of the sampler. An intermediate ring 32, FIGS. 2 and 3B, provides added support for lower tube 28 internally of the lower portion of cylindrical vessel 25, FIG. 2, and has openings 33 to permit both vapor and liquid phases to pass downwardly therethrough.

Thus, an annulus 37 is formed between the walls of the cylindrical collecting vessel 25, FIG. 2, and the coaxial tubes 27 and 28 with lower and upper ring members 29 and 31 closing the ends of the annulus. Holes 34, FIGS. 2 and 3B, in lower tube 28 permit the steam vapor phase in the annulus to travel transversely into the lower tube to exhaust from the lower end thereof while the downwardly traveling steam liquid phase continues downwardly to fill the lower end of the annulus up to a predetermined volume as set by the lowest of the tube holes 34, the preferred volume being 200 cc for the disclosed embodiment.

A mandrel or solid sealing rod 35, with sealing head 36, FIGS. 2 and 3A, is slideable in both co-axial tubes 27 and 28, FIG. 2, the sealing rod being illustrated in its open lowermost position wherein steam may pass straight through from upper tube 27, into lower tube 28, around sealing rod 35, and exhaust from the lower end of the short tube 30 into the well for penetration of the adjacent strata.

Figure 3B:
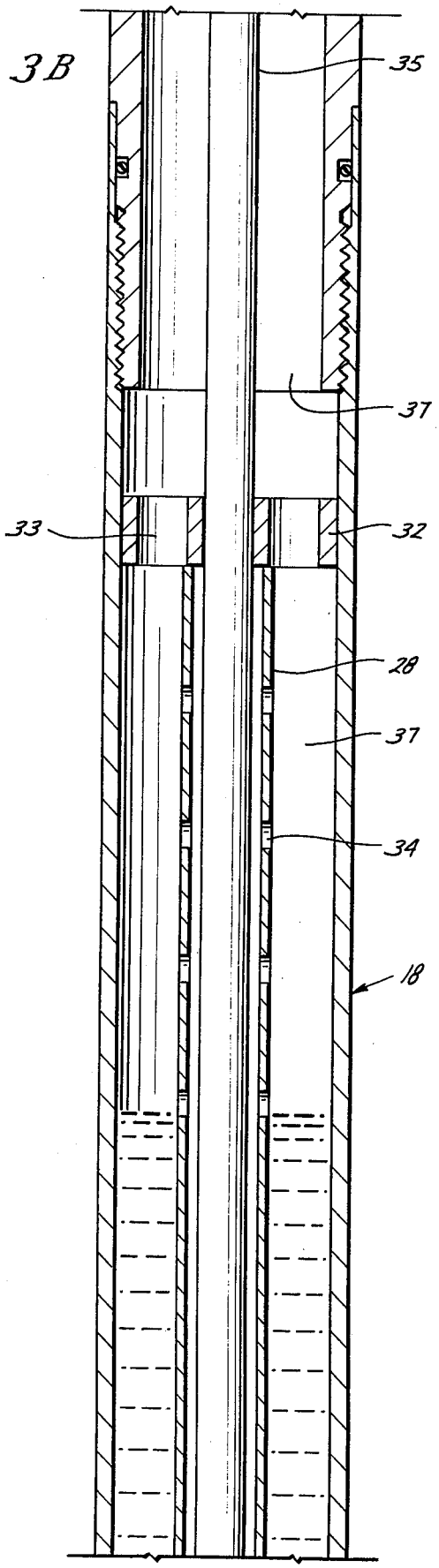
FIG. 3B is an enlarged sectional view of the middle portion of the sampler of FIG. 2.
Figure 3C:
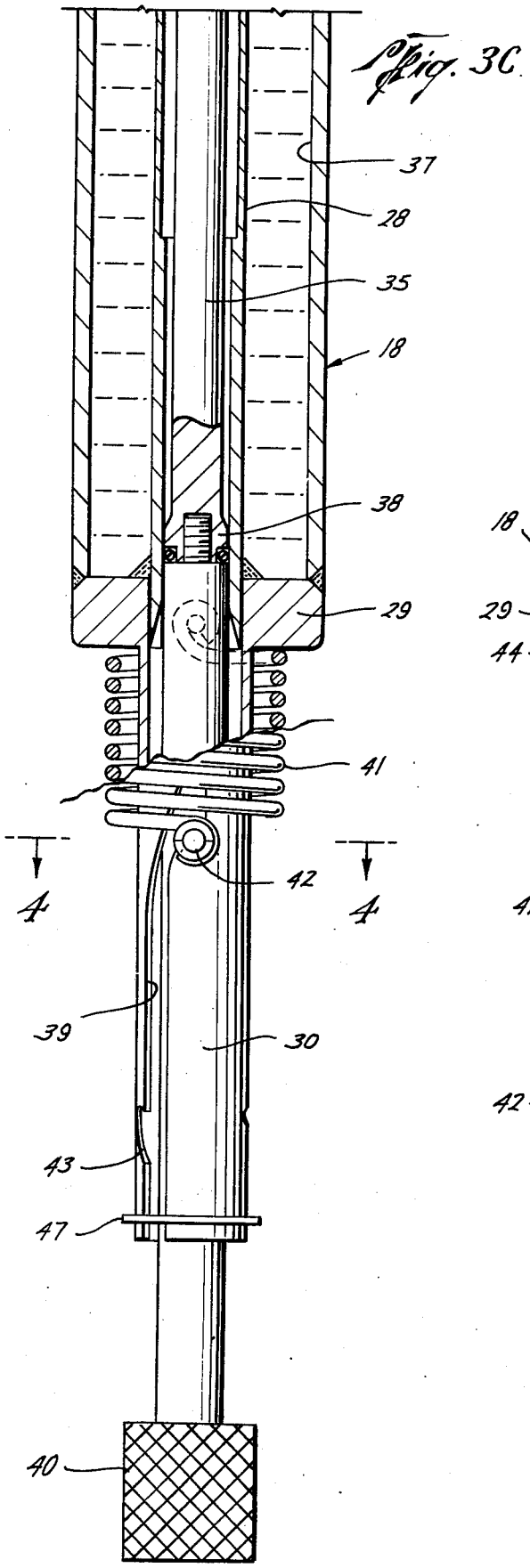
FIG. 3C is an enlarged vertical view of the lower portion of the sampler of FIG. 2 with parts in section, shown in closed position.

Sealing rod 35 is raised to its uppermost position as illustrated in enlarged details of FIGS. 3A, 3B, and 3C to seal off the annulus 37 from the tubes. In this position the upper headed end 36, FIG. 3A, with a sealing O-ring has sealed the upper tube 27 to accordingly seal the upper end of annulus 37, FIGS. 2 and 3A, formed between the walls of the elongated cylindrical sampling vessel 25 and the coaxial tubes 27 and 28, FIG. 2. Likewise, an O-ring on an enlarged lower portion 38 of the sealing rod 35, FIGS. 3A and 3C, seals the lower end of the lower tube 28 for preventing steam from leaving tube 28 and passing out the bottom of tubes 28 and 30. Accordingly, the two spaced apart co-axial tubes 27 and 28 are interconnected to form one continuous tube so that the mandrel or sealing rod 35 will effectively seal off fluid in the annulus 37 from passing out of the tubes.

In the first embodiment disclosed in FIGS. 2–5, the sampler 18 comprises sealing rod 35 with a J-latch 39, FIGS. 2, 3C, 4, and 5, on short tube 30 for guiding the relative upward movement of the sealing rod as it telescopes into the two co-axial tubes 27, 28, FIG. 2, until the sealing rod reaches its uppermost sealing position where it is locked in this latter position.

Figure 5:
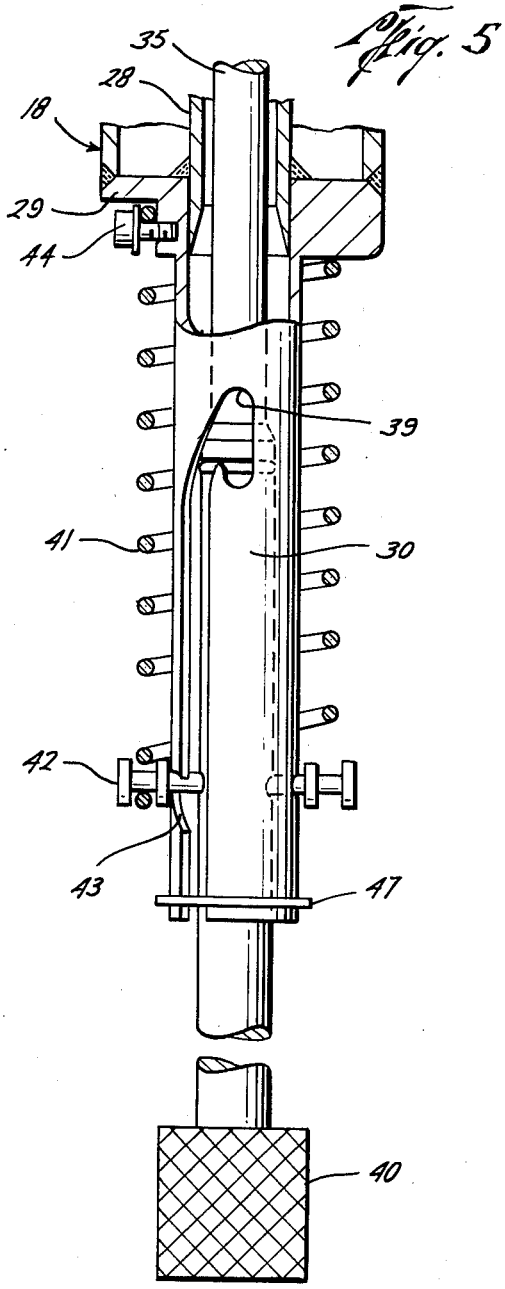
FIG. 5 is a schematic enlarged vertical view of the lower end of the sampler of FIG. 2 in the open position, with parts in section.

As seen in FIGS. 2, 3C, and 5, the lower end of sealing rod 35 has a mass weight 40, if so desired. A tension spring 41, FIG. 5, is secured at its upper end to lower ring 29 as with a screw 44 in a spring loop end with its lower end secured likewise with a spring loop around a transverse pin 42 protruding through the lower end of the sealing rod for urging the sealing rod upwardly due to spring tension forces. Short tube 30, FIGS. 2, 3C, and 5, a short tubular extension extending downwardly from the lower ring member 29 has an upside down J-type of groove, comprising the top of J-latch 39 so that the curved opening of the J-latch guides the cross-pin 42 on the lower end of sealing rod 35 into a locking slot having a vertical groove at its upper end where the cross-pin is urged upwardly by the spring 41 tension forces and is locked in the J-latch in closed position by spring tension forces for maintaining the sealing rod protruding into both of the co-axial tubes 27, 28, FIG. 2, to accordingly seal them from the annulus thereabout. A notch 43, FIGS. 3C and 5, is formed in the lower end of the substantially vertical guiding groove of the J-latch 39 for holding the sealing rod in lowered, open position against the tension of spring 41.

FIG. 3A thus illustrates the upper end of the sampler 18 with the mandrel or sealing rod 35 in its uppermost and annulus sealing position wherein none of the fluid trapped in annulus 37, and particularly the vapor phase, can escape out the top thereof.

FIG. 3B, illustrating the middle portion of the sampler 18 in closed position has trapped the desired amount of liquid phase of the fluid, as the liquid phase from steam in this case. Holes 34 in lower tube 28 are formed therein at the precise location for trapping the exact desired amount of liquid phase.

FIG. 3C discloses in greater detail the lower portion of the sampler 18 of FIG. 2 in closed position wherein the sealing rod 35 has been triggered or released from locked open position and actuated to locked closed position to trap the condensate therein for recovery at the surface. While the tension spring 41 normally maintains the pin 42 in the upper portion of the J-latch upper groove, after the sampler with its trapped high pressure steam, as at 600 psi (pounds per square inch), has arrived at the surface the external atmospheric pressure and spring tension are insufficient to prevent the sealing rod 35 from moving outwardly or downwardly as limited by the vertical slot portion in the upper end of the J-latch, FIG. 3C.

Figure 4:
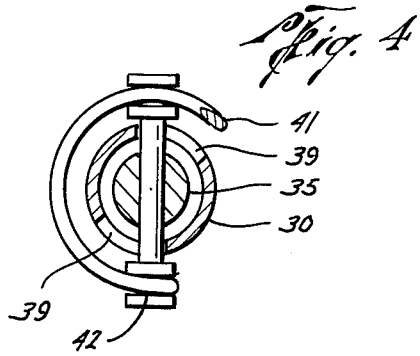
FIG. 4 is a sectional view at 4—4 on FIG. 3C.

FIG. 4, a sectional view taken at 4—4 on FIG. 3C, illustrates more details of the J-latch 39 showing transverse pin 42 being locked in upper closed position in J-latch 39.

FIG. 5, an enlarged front view of the lower sealing rod locking portion of FIG. 2, illustrates locking pin 42 being held in notch 43 of the J-latch 39 by tension forces of spring 41.

Briefly in operation, steam is injected at the top of the well into either the center tube 12, FIG. 1, or the annulus between well casing 11 and tube 14 by opening either of valves 12 or 13, respectively. After the well is preheated, the sampler 18 is lowered to the desired position at the precise depth in the well wherein the steam is injected and permitted to fill the internal annulus and purge the annulus for collecting a typical sample.

Then the spring urged pin 42 is dislodged from its notch 43, FIG. 3C, by inertial forces and raised and locked in the upper upside down J-type end of the J-latch 39. There are two methods for accomplishing the above operation. One, the wire line 19, FIG. 1, may be raised upwardly a predetermined distance, allowed to free fall or lowered very rapidly back down for that predetermined distance, and then stopped suddenly. With the sudden stop, the weighted solid sealing rod 35, FIG. 2, continues downwardly due to its inertial forces to stretch the spring 41 and free the transverse pin 42 from the notch 43. After the downward inertia forces are overcome and the retaining ring 47, FIGS. 3C and 5, prevents pin 47 from exiting the slot of the J-latch 39, the spring tension forces pull the pin 42 and the accompanying sealing rod upwardly to lock the pin in the upper end of the J-latch 39, FIG. 3C. In this position tension forces of spring 41 lock pin 42 in the top vertical slot portion of J-latch 39. At the surface, the internal pressure has actuated the sealing rod 35 to the lower end of the vertical slot forming the upper part of the J-latch 39, as seen in FIGS. 2, 3C and 5. Likewise in this position, the enlarged portions 36 and 38, FIG. 2, of the sealing rod 35 seal the fluid in annulus 37 for recovery at the surface. The second method comprises merely skipping the step of raising the wire line 19 by a predetermined distance. Instead, the wire line is dropped for the predetermined distance, room permitting, stopped suddenly, and permitting the inertial forces to unlatch the pin 42 from the lowered position and permitting the spring tension forces to raise and lock the pin in the upper position. Thus with the sealing tube or mandrel 35 now locked in the J-latch 39, the sampler is raised to the surface, allowed to cool, the sealing rod raised slightly, rotated slightly, lowered to open position, and the two portions of the elongated vessel 25 unscrewed for recovery of the steam condensate and vapor for analysis. The sample may then be checked for either total dissolved solids or chloride content and compared with the steam generator feedwater total dissolved solids or chlorides to determine the quality of the steam or ratio of the total dissolved solids or chlorides in the liquid at the particular and desired point of injection to the total dissolved solids or chlorides in the feedwater at the surface. Conductivity meters provide an easy and simple system for analyzing for total dissolved solids.

The quality "Q" of the steam of a typical sample may be determined as follows: (ppm - parts per million)

$$Q\,(\%) = 100\ 1 - \frac{\text{total dissolved solids entering wellhead}}{\text{total dissolved solids sample}}$$

$$Q = 100\ 1 - \frac{1000\ \text{ppm}}{5000\ \text{ppm}} = 80\%$$

Preferably the higher the quality of the steam at the point of injection into the earth, the greater the penetration and the greater the production of oil from the production wells.

MODIFICATION

Figure 6:
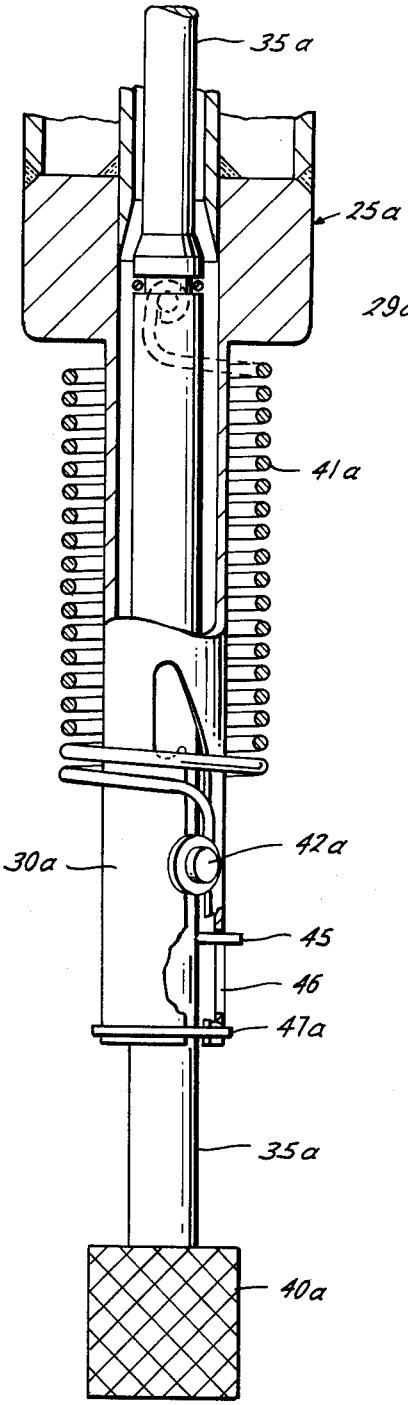
FIG. 6 is an enlarged schematic vertical view of a modification of the sampler of FIG. 5 in the open position, with parts in section.
Figure 7:
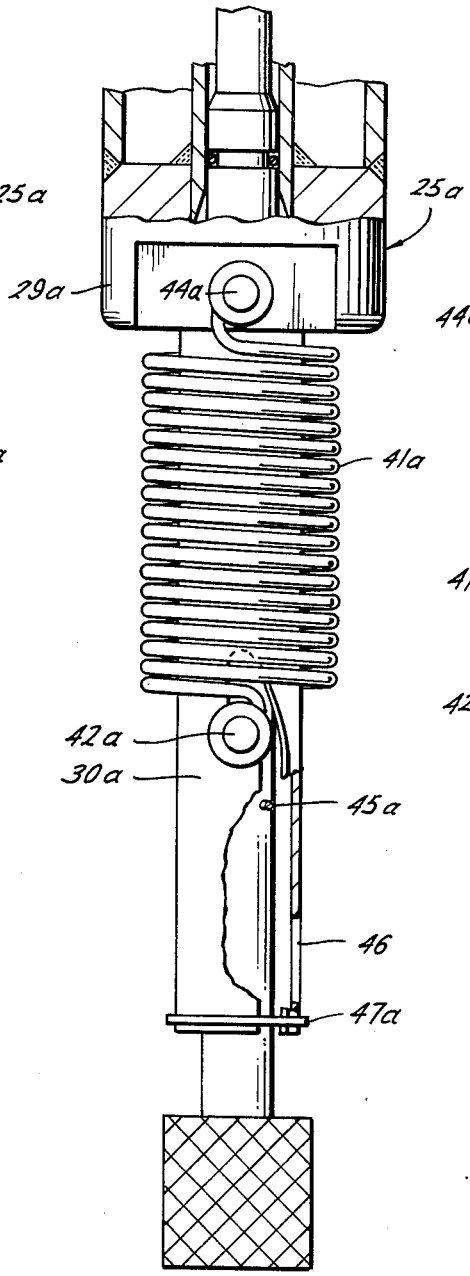
FIG. 7 is a schematic view of the sampler of FIG. 6 illustrated in closed position, with parts in section.
Figure 8:
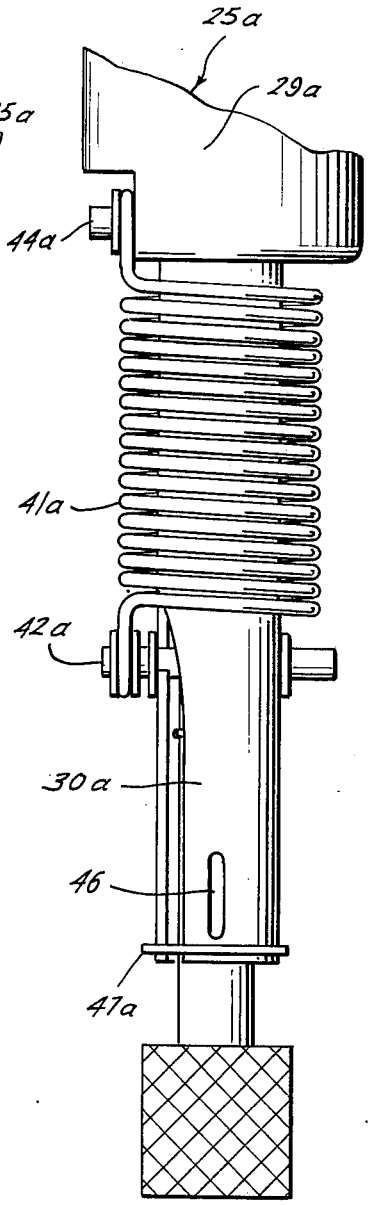
FIG. 8 is a side view of FIG. 7.

FIGS. 6, 7, and 8, schematic vertical views of a modification of FIG. 2, with parts in section, disclose a steam sampling elongated cylindrical vessel 25*a* with a different means for latching the sealing tube in sealed position.

The upper end portion of sealing rod 35*a*, FIG. 6, is similar to that of sealing rod 35 of FIG. 2. In assembly and fastening of the spring 41*a* in the J-latch assembly, the upper end of the spring is secured to the lower ring 29*a*, FIGS. 7 and 8, with a screw 44*a* similar to the spring 41 of FIGS. 3C and 5. The lower end of the spring is formed in a loop for securely fastening the spring end to the headed bolt or pin 42*a*, FIGS. 6–8.

As illustrated in FIG. 6, a pin 45 is threaded in a suitable threaded hole in sealing rod 35*a* to project from the rod and through a slot 46 in the lower end of the short tube 30*a*. The pin 45, FIG. 6, is designed to shear with substantially the same inertial force that the first embodiment pin 42, FIG. 5, requires to be forced from its notch 43 against the spring tension.

FIG. 7 is a longitudinal schematic view of the sampler 25*a* of FIG. 6, with parts in section, but illustrated in closed position after arriving at the surface.

Accordingly, in operation of the modified elongated sampling vessel 25*a*, FIG. 6, after the open sample has hung at the predetermined depth or location in the well and has collected the sample of steam or other fluid, both liquid and vapor, a sudden downward inertial force is applied to the sampling vessel 25*a* as by dropping it a predetermined distance and suddenly stopping it, as is the first modification decelerated. The continued downward travel of the sealing rod 35*a* with its weight 40*a* against the tension of spring 41*a* travels the pin 45 from the top of slot 46 to the bottom of the slot where the pin is sheared off to leave a short non-obstructive stub 45*a*, FIG. 7. After the downward inertia of sealing rod 35*a* and its weight 40*a* is overcome by the shearing forces of shear pin 45 and by the spring 41*a*, and by ring 47*a*, the sealing rod is actuated upwardly to the closed and locked position by the spring tension as illustrated in FIGS. 7 and 8, wherein the pin 42*a* is locked in the top of J-latch 39. Then the sampler is raised to the surface where the internal pressure extends the sealing rod 35*a* a small amount to the position illustrated by FIGS. 7 and 8.

FIG. 8 is a side view of the sample vessel 25*a* of FIG. 7.

Then after cooling of the sampler at the surface, the liquid phase and vapor are recovered by unscrewing the upper and lower portions of the elongated cylindrical sampling vessel 25*a* from each other as in the first embodiment.

Obviously other methods may be utilized for collecting steam samples and for forming a steam sampler like the embodiments of either FIG. 2 or FIG. 6 than those listed above, depending on the particular information and liquid and/or vapor desired.

Accordingly, it will be seen that at least one method for collecting a steam sampler at the bottom of a well, at least one method for forming a steam sampler, and at least two embodiments of a steam sampler have been described which will operate in a manner which meets each of the objects set forth hereinbefore.

While only two methods of the invention and two mechanisms have been disclosed, it will be evident that various other methods and modifications are possible in the arrangement and construction of the disclosed methods and steam collecting samplers without departing from the scope of the invention and it is accordingly desired to comprehend within the purview of this invention such methods and modifications as may be considered to fall within the scope of the appended claims.

We claim:

1. A method for collecting a sample of steam at any desired location down in a well having free passage for a cylindrical collecting vessel suspended on a wire line therein comprising the steps of, a. passing the steam that has arrived at the desired location through a tube means internally of the cylindrical collecting vessel, b. passing a portion of the steam vapor phase and liquid phase from the tube means through an upper opening in the tube means out into an annulus formed between the tube means, and the cylindrical collecting vessel, c. collecting the steam liquid phase and vapor phase in the annulus, d. passing the steam vapor phase back into the tube means through side openings therein and out an opening in the lower end of the tube means, e. inserting a solid massive mandrel up into the lower end of the tube means with the lower end of the solid mandrel protruding below the cylindrical vessel, f. latching the solid massive mandrel to the wire line supported vessel in a lowered and liquid unsealing position with an inertial operated spring latch, g. lowering the cable and vessel rapidly for a predetermined distance, h. unlatching the solid massive mandrel from the vessel by sudden deceleration of the wire line and vessel, i. raising the solid mandrel relative to the tube means to latch the solid massive mandrel in raised liquid sealed position wherein the openings are sealed closed by inertial forces and spring action of the latch to accordingly seal any steam liquid phase in the annulus, j. raising the cylindrical vessel to the surface, and k. cooling the cylindrical vessel for removal of the steam liquid phase.

2. A method for assembling a sampler for collecting a sample of fluid comprising vapor and liquid at any desired location in a well having free passage for a cylinder suspended on a cable therein comprising, a. forming an elongated cylinder having closed upper and lower ends with a diameter being less than that of the well in which it is lowered, b. attaching a coupling means on the cylinder upper end for connecting to the cable for lowering the cylinder to the desired position, c. forming slots in the cylinder upper end for receiving the fluid, d. fixedly mounting with an annular disk the top of an upper tube of two upper and lower co-axial, spaced apart tubes concentrically positioned in the upper portion of the cylinder below the slots for receiving the fluid from the slots and for sealing the top of the upper portion of an annulus formed between the tubes and the cylinder, e. fixedly mounting with a second annular disk the lower end of the lower co-axial tube concentrically in the cylinder lower end for sealing the bottom of the lower portion of the annulus formed between the tubes and the cylinder, f. spacing the two co-axial tubes axially from each other a substantial distance apart so that a portion of the fluid including the fluid liquid phase and the fluid vapor phase passes out into the annulus, g. perforating the upper end of the lower tube so that the fluid vapor phase passes back into the lower tube through the perforations therein for exhausting from the cylinder bottom as the fluid liquid phase collects in the annulus up to the perforations, h. slideably mounting a sealing rod internally of the lower co-axial tube with a lower portion of the sealing rod protruding below the cylinder, i. forming latch means on the slideably mounted sealing rod for releasably locking the sealing rod from a locked lowermost position to a locked uppermost position for sealing the liquid and vapors in the annulus, and j. forming the latch means with a spring having tension thereon when in the lowermost position for urging the sealing rod upwardly whereby a sudden downward acceleration applied to the sealing rod will release the sealing rod for spring urging it from the lowermost position to its uppermost position to close the upper tube and the bottom of the lower co-axial tube for sealing the liquid and vapors in the annulus for recovery at the surface.

3. A sampler for collecting a sampler of fluid liquid phase and fluid vapor phase at any desired location in a well comprising, a. cylindrical sampling vessel means having a slotted upper end for receiving fluid and a lower end for ejecting the fluid, b. coupling means on said upper end for attaching cable support means thereto for lowering the cylindrical sampling vessel means to a position adjacent the desired location.

c. tube means having upper and lower openings extending internally of said cylindrical sampling vessel means from a position below said slotted upper end to a position down and out the lower end for receiving fluid from said slotted upper end and for ejecting fluid from the lower end, d. said cylindrical sampling vessel means having closure means around each end of said tube means for forming a closed ended annulus around said tube means, e. openings in said tube means for permitting fluid vapor phase and liquid phase therein to pass out into said annulus whereby the fluid vapor phase phasses back into said tube means for ejecting from said lower end and the fluid liquid phase collects in the annulus, and f. sealing rod means slideably mounted in said tube means responsive to a sudden upward acceleration of said cylindrical vessel means relative to the sealing rod means for sealing said upper and lower openings in said tube means for sealing said annulus with the fluid liquid phase and the fluid vapor phase therein for recovery at the surface.

4. A sampler a recited in claim 3 wherein, a. said tube means comprises two upper and lower co-axial spaced apart tubes fixedly mounted in said cylindrical sampling vessel means so that a substantial portion of said steam passes out into said annulus for separation of the fluid liquid phase from the fluid vapor phase.

5. A sampler as recited in claim 4 wherein, a. a plurality of holes are formed in an upper portion of said lower tube for permitting only the fluid vapor phase to return to said lower tube thereby trapping the fluid liquid phase in said annulus, and b. said lowest hole being positioned in the lower tube to permit all excess fluid liquid phase over a predetermined amount to flow out of the holes to exit downwardly through the tube.

6. A sampler as recited in claim 3 wherein, a. said cylindrical vessel means has spring latch means thereon, b. said sealing rod means comprises a solid mandrel slideably mounted in said tube means and extending from the lower end of said tube means and said cylindrical vessel means, c. said spring latch means being responsive to said sealing rod means being moveable downwardly upon downward acceleration of said mandrel relative to said cylindrical vessel means for unlocking said sealing rod means from an annulus open position, d. said sealing rod means being responsive to said spring latch means for being raised to an annulus sealed position wherein said solid mandrel seals said upper and lower openings in said tube means, and e. said spring latch means releasably locking said solid mandrel relative to said tube means in said annulus sealed position when said mandrel has moved to its uppermost position, for recovery of the fluid liquid phase and the fluid vapor phase at the surface.

7. A sampler for collecting a sample of steam at the bottom of a well comprising, a. a cylindrical vessel having open upper and lower ends, b. tube means extending longitudinally internally of said cylindrical vessel for receiving steam from said cylindrical vessel upper end and for ejecting it through a lower end of said tube means extending through said cylindrical vessel lower end, c. closure means for forming a closed ended annulus between said tube means and said cylindrical vessel, d. openings in said tube means for permitting the steam therein to pass out into said annulus for trapping the steam liquid phase in the annulus as the vapor phase passes back into said tube means for ejection, and e. sealing solid mandrel means slideably mounted in said tube means responsive to a sudden downward acceleration of said sealing solid mandrel means relative to said cylindrical vessel, and a spring means for actuating said sealing solid mandrel means to its upper most position for sealing said tube means openings for sealing said annulus with the steam liquid phase and vapor phase therein.

8. A sampler as recited in claim 7 wherein, a. said sealing solid mandrel means has J-latch means for releasably locking said sealing solid mandrel means in its uppermost position for maintaining said annulus sealed with its steam liquid phase and vapor phase therein.

9. A sampler as recited in claim 7 wherein, a. said spring latch means has corresponding J-latch means mounted on said lower end of said cylindrical vessel means, and b. said J-latch means has notch means for releasably locking said solid mandrel in a lowermost position for maintaining said tube means openings in open position for receiving the steam.

10. A sampler as recited in claim 7 wherein, a. said spring latch means has corresponding J-latch means mounted on said lower end of said cylindrical vessel means, and b. said J-latch means has shear pin and slot means for releasably locking said solid mandrel in a lowermost position for maintaining said tube means openings in open position for receiving the steam.

* * * * *